United States Patent [19]

Field

[11] Patent Number: 4,774,488

[45] Date of Patent: Sep. 27, 1988

[54] ELECTRIC CUTOUT HAVING A LINK BREAK FUSE HOLDER

[75] Inventor: Donald E. Field, Brashear, Mo.

[73] Assignee: Kearney-National, Inc., Atlanta, Ga.

[21] Appl. No.: 135,010

[22] Filed: Dec. 18, 1987

[51] Int. Cl.[4] ..... H01H 71/10; H01H 71/20

[52] U.S. Cl. ..... 337/172; 337/177

[58] Field of Search ..... 337/167–181, 337/156, 157

[56] References Cited

U.S. PATENT DOCUMENTS 2,835,764 5/1958 Earle ..... 337/218

2,836,681 5/1958 Bracey ..... 337/157

*Primary Examiner*—H. Broome

*Attorney, Agent, or Firm*—Rodgers & Rodgers

[57] ABSTRACT

An electric cutout of the link break type includes a fuse holder comprising a hollow fuse tube of insulating material, a lower tube casting secured to one end of the fuse tube, a conducting hinge element pivotally mounted on one side of said lower tube casting and having a pair of coaxial trunnions seated in a pair of jaw contacts constituting one terminal of the cutout, an ejector element pivotally mounted on the conducting hinge element biased away from the fuse tube and having its swing end normally spaced from one end of the fuse tube and substantially normal to the axis of the fuse tube together with a ramp portion angularly disposed to the axis of the fuse tube and to the swing end portion thereof and integral therewith, a fuse link disposed within the fuse tube and having an extension secured to the conducting hinge element and in engagement with the swing end of the ejector element so as to hold the conducting hinge element and the ejector in their normal positions, a manually operable fuse link breaking element pivotally mounted on the lower tube casting and having its swing end portion normally interposed between the collar and the ejector element and in contact with the ramp portion of the ejector element whereby sliding movement of the link breaking element along the ramp imparts a gradually increasing link breaking force to the fuse link.

10 Claims, 4 Drawing Sheets

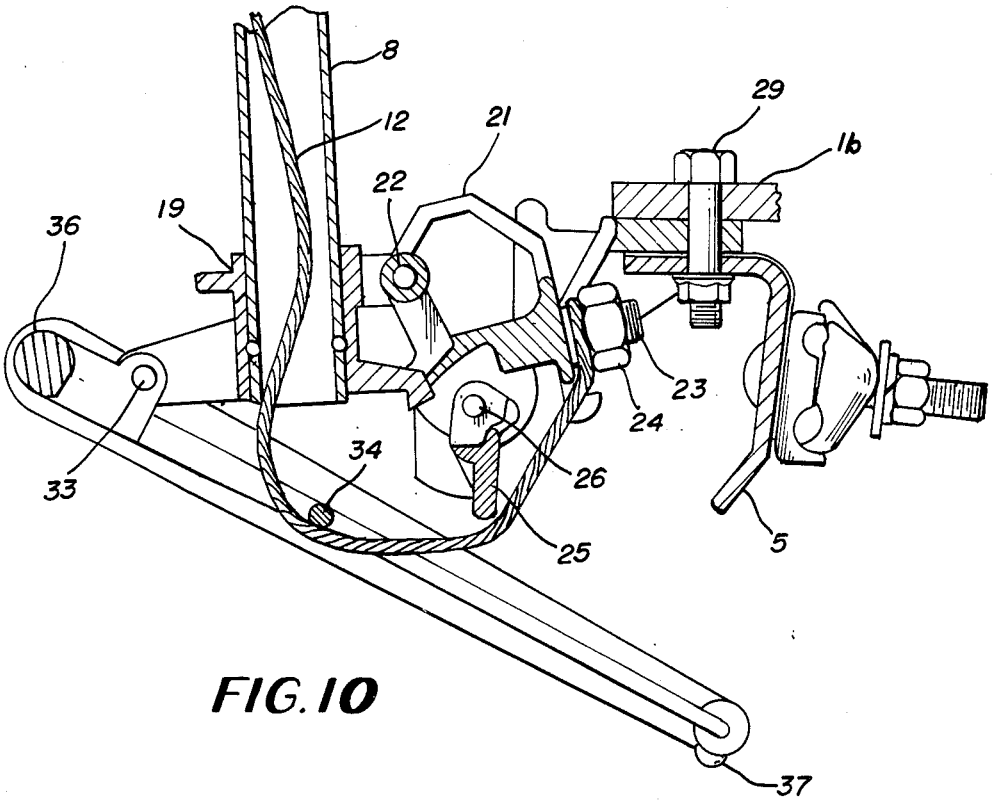
FIG. 10
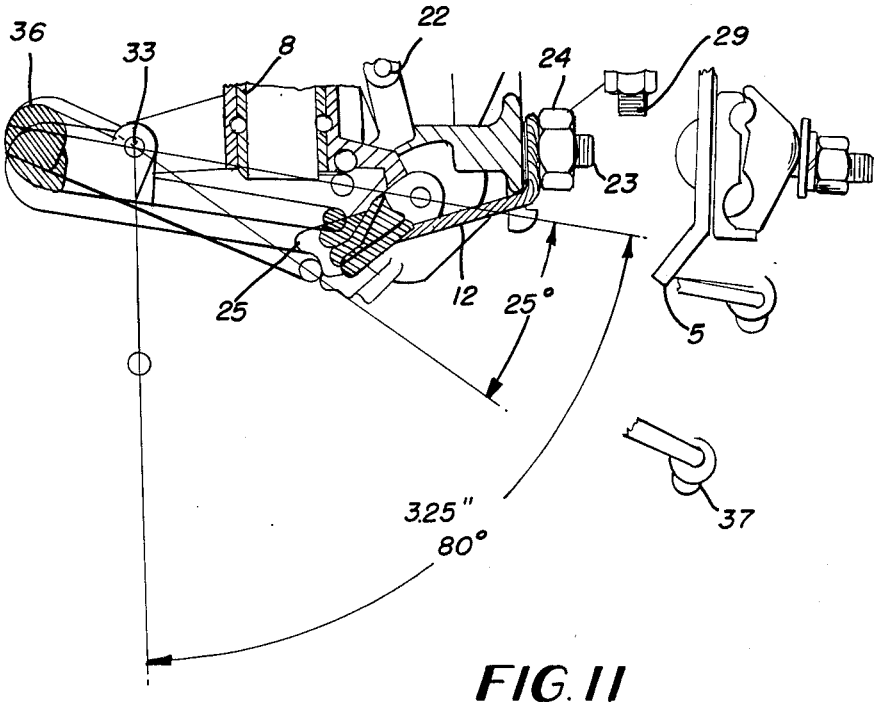
FIG. 11
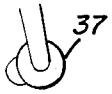

ELECTRIC CUTOUT HAVING A LINK BREAK FUSE HOLDER

TECHNICAL FIELD

This invention relates to an electric cutout for affording protection against overload and fault conditions automatically and which in addition is arranged with manually operable means for mechanically breaking the cutout fuse link under normal load conditions so as to render the cutout operable as an electric switch.

BACKGROUND ART

Electric fusible elements of the type commonly used in conjunction with electric cutouts normally include a strain wire together with a fusible element which are connected in parallel and which function in known manner. In order to utilize an electric cutout as a load break device, a tensile force is applied to the fuse link and mechanically ruptures both the strain wire and the fusible element thereby to initiate circuit interruption.

In some instances the fuse link of an electric cutout includes a straight strain wire normally maintained in tension together with a helical fusible element which is in parallel circuit relation with the strain wire. In such constructions a mechanical tensile force applied to the strain wire and to the fusible element effectively breaks the strain wire but may not have sufficient travel in order to rupture the helical fusible element which may simply extend in length as a coiled spring but without being broken.

In instances in which a helical fusible element is used, it is necessary to impart a substantial tensile force initially thus to break the strain wire and thereafter to impart a substantial distance of travel to the end of the helical element by the force applying mechanism which travels over a substantial distance thereby to stretch and then to break the helical element.

U.S. Pat. No. 2,836,681 issued May 27, 1958 discloses a link break cutout wherein the thrust of a linkage mechanism imparts an initial force of substantial magnitude and thereafter due to the change in angular relationship of the linkage mechanism to the force applying structure effects a substantial reduction in force applied and which increases the degree of travel of the link breaking mechanism.

U.S. Pat. No. 2,835,764 issued May 20, 1958 is said to constitute an improvement over U.S. Pat. No. 2,836,681 and utilizes an arrangement wherein the first part of opening movement toward breaking fusible elements utilizes a cam which rides on a pivoted part to impart substantial fuse link breaking force. Thereafter a gear segment on a manually movable part engages a pinion to impart rotary motion to the pinion together with a certain travel distance to the separated portions of the strain wire and to the fusible element.

SUMMARY OF THE INVENTION

According to this invention in one form, a cutout comprises a hollow tube of insulating material, a fuse link having a strain wire and a fusible element and disposed in said tube and having a conductor extending out of the lower end of said tube, a lower tube casting secured to said lower end of the fuse tube, a conducting element pivotally mounted on the lower tube casting, an ejector pivotally mounted on the conducting element, a manually operable link breaking element having a part normally interposed between the ejector and the lower tube casting, said conducting element and said ejector being held in normal positions by securement of said conductor to said conducting element, the ejector having a ramp portion which is normally in engagement with a part of said manually operable link breaking element so that swinging movement of the manually operable link breaking element causes the part which is in engagement with the ramp to slide downwardly on the ramp while rotating the ejector element so as to impart an increasing force to said conductor thereby to break the strain wire and thereafter to impart substantial travel to said part of said link breaking element to effect substantial travel of said conductor and of the broken portions of the strain wire and of the fusible element so that these parts are effectively withdrawn from the fuse tube during a load breaking operation irrespective of whether the fusible element is a straight fusible wire connected in parallel to the strain wire or whether the fusible element is in the form of a helix. Thus by the invention, a fuse holder for a link break cutout is provided which is compatible with cutouts of other interchangeable cutout manufacturers.

BRIEF DESCRIPTION OF THE DRAWINGS

In the drawings,

FIG. 10 is a view similar to FIG. 3 which shows the structure from the opposite side and following a link breakage operation;

FIG. 11 is a view similar to FIG. 10 but which indicates the arc length or separation of conducting parts during an intermediate and final condition of the parts as a link breaking operation is effected.

BEST MODE OF CARRYING OUT THE INVENTION

Figure 1:
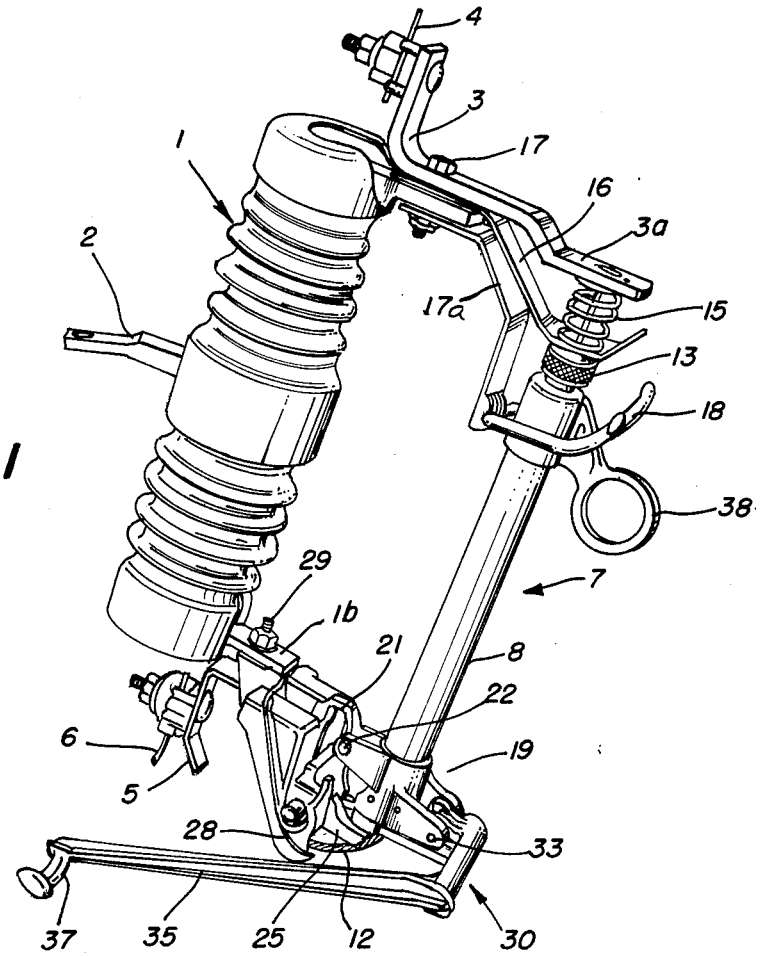
FIG. 1 is a perspective view of an electric cutout embodying the invention.
Figure 2:
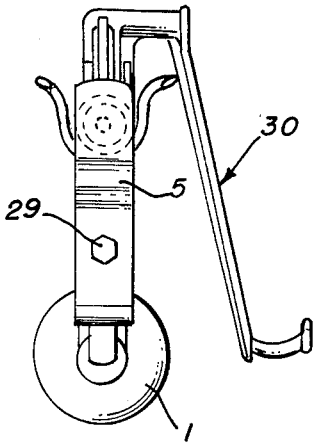
FIG. 2 is a view from below of the structure shown in FIG. 1.

With reference to FIG. 1, the numeral 1 indicates an insulator supported in known manner by a supporting element 2 which in turn is mounted on some suitable support such as a pole cross arm. Terminal 3 secured atop insulator 1 forms a connection for a distribution conductor 4 while terminal 5 at the lower end of insulator 1 forms a connection for a distribution conductor 6. Fuse holder 7 as shown in FIGS. 1 and 4 includes a hollow tube 8 formed of insulating material within which a fuse link 11 as shown in FIG. 4 is disposed.

Fuse link 11 includes a buttonhead 9 secured to metallic structure, an arc shortening rod 10 to the lower end of which fuse link 11 extends and to the bottom of which a conductor 12 is connected which extends outwardly through the bottom end of the fuse tube 8. A cap 13 is internally threaded so as to cooperate with the threads 14 formed on upwardly extending porton of metallic sleeve 15.

As is shown in FIG. 1, a helical compression spring 15 is interposed between the portion 3*a* of terminal 3 and the right hand portion of a conductor 16 which is secured in conducting relation to terminal 3 by bolt 17. Conductor 16 is appropriately configured so as to receive the upper end of cap 13 in conductive relationship therewith. A bracket 17*a* is also mounted to terminal 3 by bolt 17 and serves to support connector hooks 18 arranged to cooperate with a separate load breaking interrupter of known construction.

Figure 4:
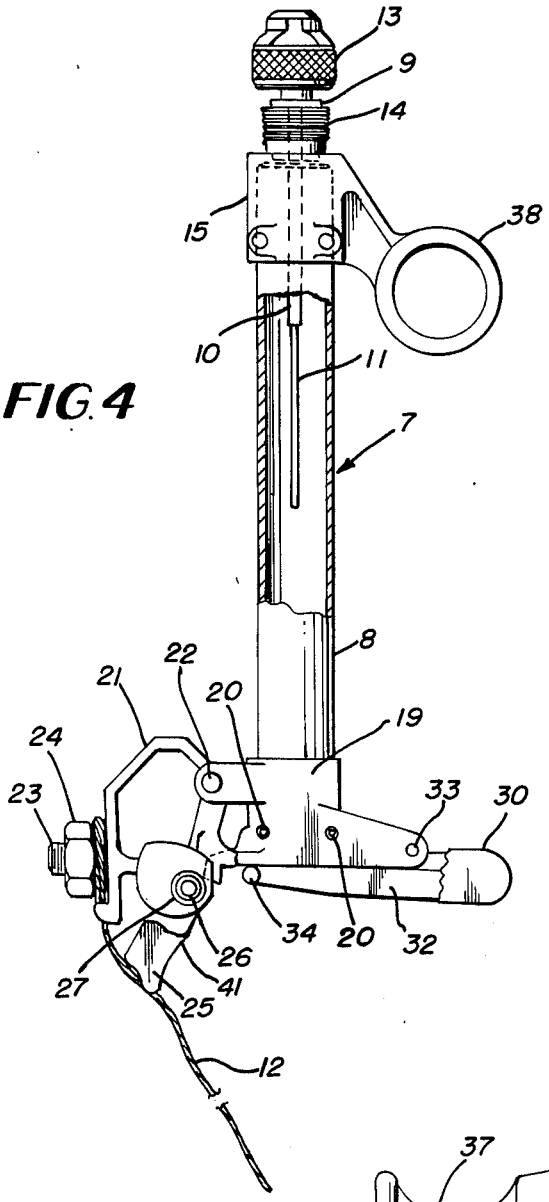
FIG. 4 is a side view of a fuse holder incorporated into the structure of FIGS. 1, 2 and 3 and which embodies the invention.

At the lower end of insulating tube 8 a lower tube casting 19 is secured in known manner by structure such as pins 20 as shown in FIG. 4. A conducting element 21 is pivotally mounted to lower tube casting 19 by pin 22. A threaded conducting stud 23 is securely mounted to conducting element 21 and a nut 24 cooperates with stud 23 to form a connection for the outwardly extending conductor 12 connected to the lower end of fusible element 11. An ejector 25 is pivotally connected at shaft 26 to conducting element 21.

Figure 6:
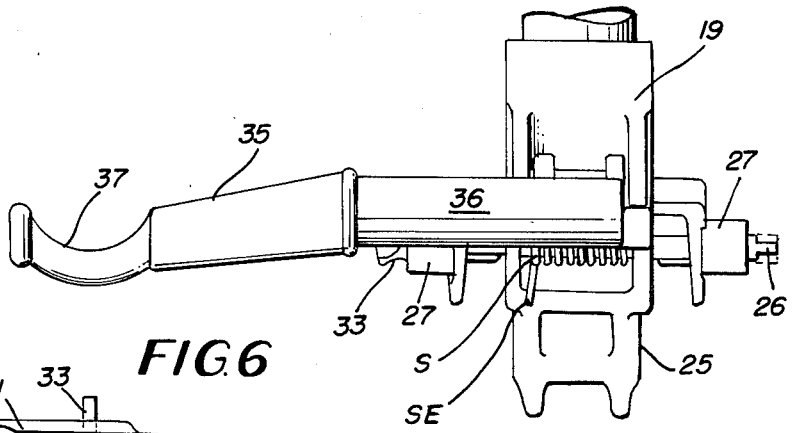
FIG. 6 is a view of the lower portion of the fuse holder shown in FIG. 4 as viewed from the right hand side of FIG. 4.
Figure 7:
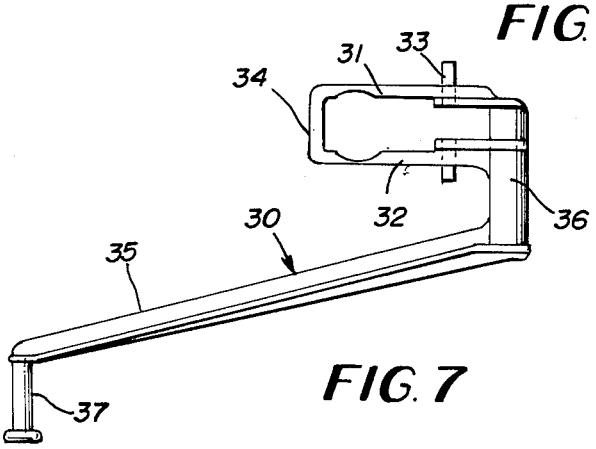
FIG. 7 is a view of the manually operable element which imparts link breaking force to the fusible element.

For the purpose of imparting a bias to ejector 25 which tends to rotate the ejector in clockwise direction as viewed in FIG. 4, a helical spring S as shown in FIG. 6 is disposed about the pivot pin 33 and is arranged with one end SE in engagement with a part of the ejector 25 as best shown in FIG. 6. The other end of spring S is anchored against a part of conducting element 21. Conducting element 21 includes trunnions 27 which are seated in the jaw elements 28 supported by element 1*b* secured to the lower end of insulator 1 and which by means of bolt 29 are electrically connected with terminal 5. A manually operable link breaking element generally indicated by the numeral 30 as best shown in FIG. 7 includes a pair of arms 31 and 32 pivoted by pins 33 to collar 19. Arms 31 and 32 are interconnected at their swing ends by cross bar 34. Operating lever 35 is connected by integral structure 36 with the arms 31 and 32 and includes an end portion 37 which is specially adapted for engagement by a hook stick or other suitable operating element.

Figure 3:
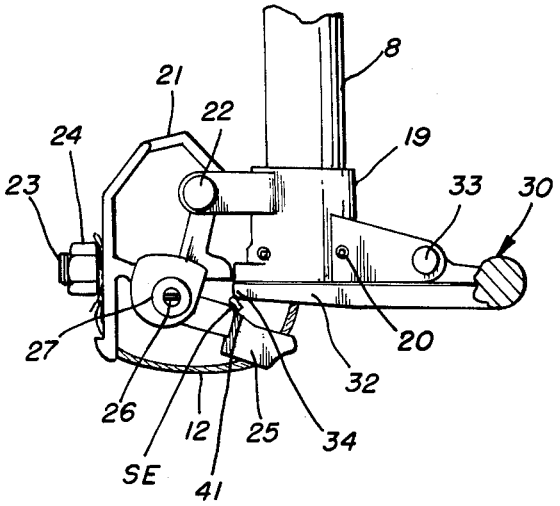
FIG. 3 is a view of the lower portion of FIG. 1.

The structure arranged as shown in FIG. 1, i.e., the ejector 25 and the conducting element 21 are held in their current carrying positions as shown in FIGS. 1 and 3 by conductor extension 12 which is wrapped about stud 23 and secured by nut 24. To mount the fuse holder 7, a hook stick or other suitable element is inserted within the ring 21 and the fuse holder is elevated to cause the trunnions 27 to rest in the jaws 28. Thereafter the fuse holder is swung by a hook stick inserted into ring 38 so that the cap 13 rides underneath the conductor 16 which is held downwardly against the cap by the action of spring 15. The circuit with its fuse holder in place is then in condition to interrupt fault or overload currents and is also ready for load break operation in accordance with this invention.

Figure 5:
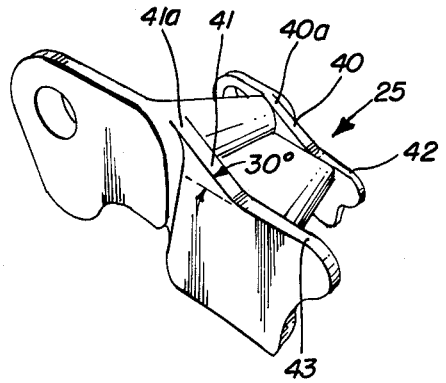
FIG. 5 is a perspective view of an ejector formed acording to one aspect of the invention.

The ejector 25 is best shown in FIG. 5 includes ramp portions 40 and 41 which are angularly disposed with respect to the planes 42, 43 of the swing ends of the ejector. This angle may vary between 20 degrees and 40 degrees. The swing end parts 42 and 43 of the ejector are in perpendicular or normal relationship to the axis of the fuse tube 8 when the parts are in current carrying position as shown in FIG. 1. Preferably the angular disposition of the ramps 40 and 41 to the elements 42 and 43 is approximately 30 degrees as indicatd in FIG. 5.

With the parts arranged in their normal positions as represented in FIG. 1, the cross arm 34 of the manually operable link break element 35 is immediately adjacent the lower end of fuse tube 8 as shown in FIG. 3. The ejector 25 is disposed as shown in FIG. 1 and the portions 40*a* and 41*a* of ramps 40 and 41 are disposed immediately below cross arm 34. Of course the ejector is maintained in this position due to the force applied to its swing end by conductor 12.

In order mechanically to break the fuse link 11, a force is applied in a counterclockwise direction to manually operable link braking element 35 as viewed in FIG. 1. This force causes the cross arm 34 to ride downwardly along the ramps 40 and 41. The arc length at the time when cross arm 34 rides off of the swing end of ejector 25 is approximately one inch as shown in FIG. 11. During this force applying movement, fuse breaking force of substantial magnitude is gradually applied to the fuse link so as to cause it to break without causing substantial stress and undesired deformation of force bearing parts. This action imparts swinging movement to ejector 25 which is in a counter-clockwise direction about pivot 26 best shown in FIG. 10. The force thus applied is adequate for breaking strain wires and straight fusible elements in parallel with the strain wires. In those instances where the fusible element is in the form of a helix, continued swinging movement of the cross arm 34 about pivot 33 is effected and results in travel of cross arm 34 over a substantial distance and moves conductor extension 12 and of the portions of the fuse link 10 connected therewith by a distance in excess of three inches as shown in FIG. 11 so as positively to effect rupture of the fusible element as well as of the strain wire even though the fusible element may be in the form of a helix which action is followed by expulsion action of any arc which is established as a result of the rupture.

Figure 8:
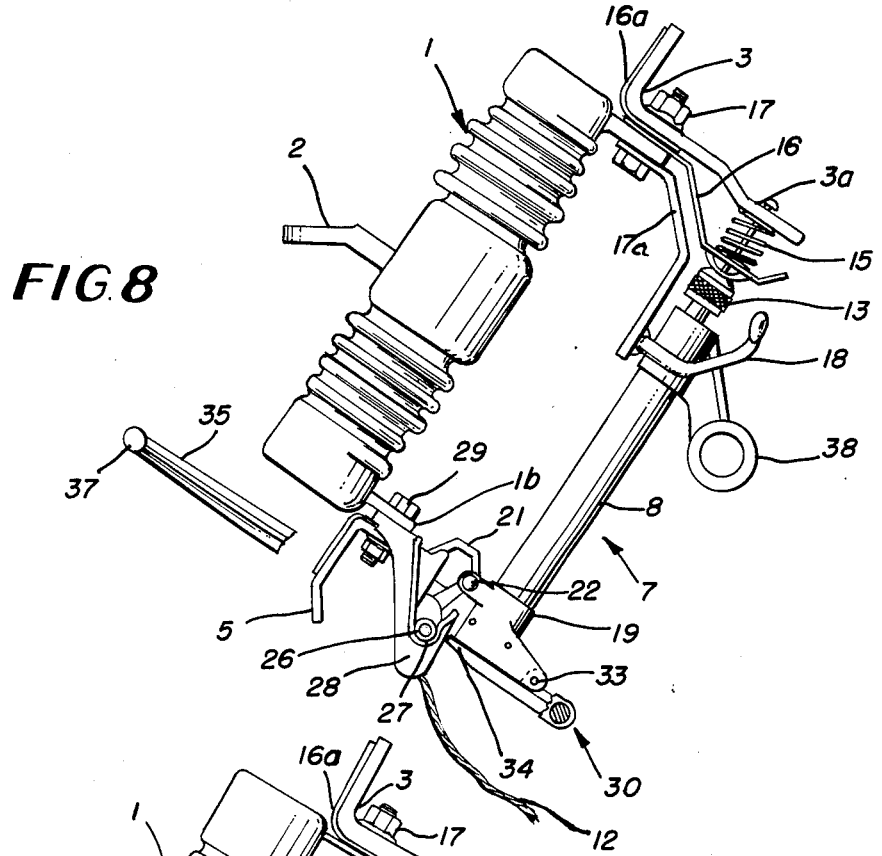
FIG. 8 is a side view of the mechanism which is somewhat similar to the perspective view of FIG. 1 and which shows the parts in the positions which they occupy following breakage of the fusible element.
Figure 9:
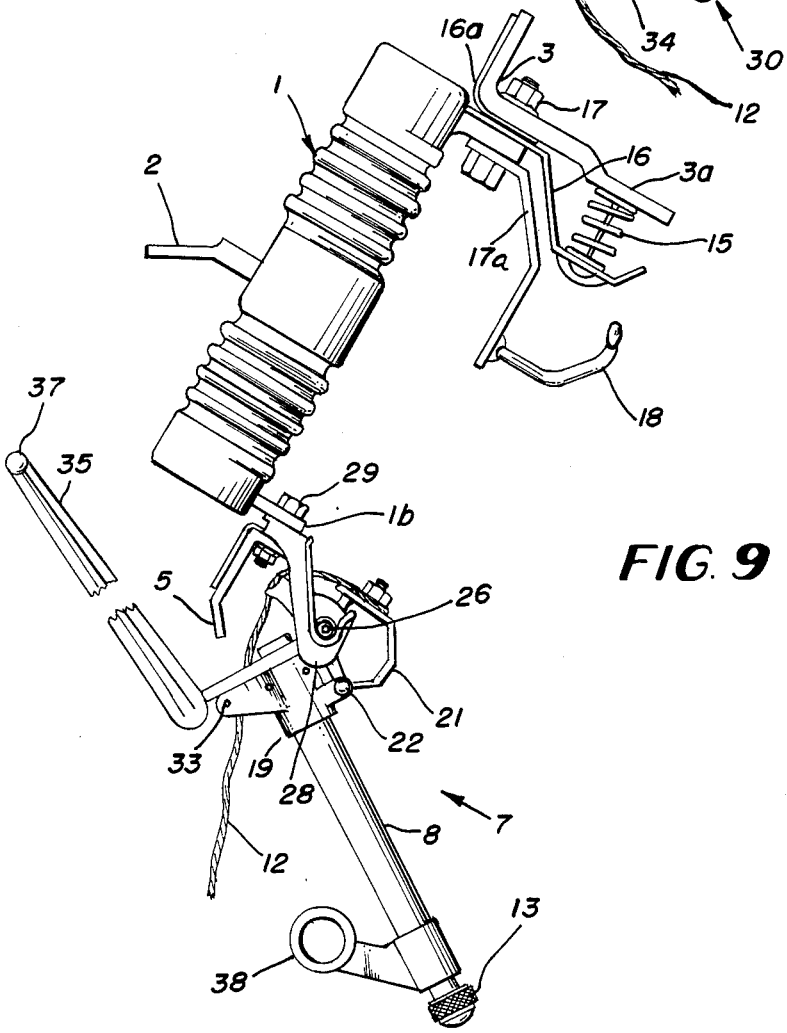
FIG. 9 shows the final disposition of parts following a circuit interrupting operation.

FIG. 8 is a view similar to FIG. 1 but shows the parts in positions which they occupy shortly following interruption of overload or fault conditions by the fuse link and FIG. 9 shows the positions of the parts following a mechanical load breaking operation or an interrupting operation due to a fault or overload condition. Shunt 16*a* is in contact with conductor 16 as shown in FIGS. 8 and 9 but does not appear in FIG. 1 which is a perspective view.

I claim:

1. An electric cutout comprising a lower terminal element having a pair of spaced jaws, a fuse holder including a hollow fuse tube of insulating material and having a major axis, a lower tube casting secured to one end of said fuse tube, a conducting hinge element pivotally mounted on one side of said lower tube casting and having a pair of coaxial trunnions mounted on opposite sides thereof and disposed respectively in said jaws, an ejector element pivotally mounted on said conducting hinge element and having a swing end portion normally spaced from said one end of said fuse tube and substantially normal to the major axis thereof and having a ramp portion angularly disposed to said major axis of said fuse tube and to said swing end portion thereof and integral therewith, a fuse link disposed within said fuse tube with one end anchored at the other end thereof and having a conductor forming an extension out of said one end of said fuse tube, means securing said extension to said conducting hinge element so as normally to hold said conducting hinge element in a fixed position relative to said fuse tube and engageable with the swing end of said ejector element so as to hold it in its normal position relative to said one end of said fuse tube, means biasing said ejector for swinging movement in a direction away from said one end of said fuse tube, a manually operable fuse link breaking element pivotally mounted on said lower tube casting and having its swing end portion normally interposed between said lower tube casting and said ejector element and in contact with said ramp portion of said ejector element whereby sliding movement of said link breaking element along said ramp imparts a gradually increasing link breaking force to said link so as to break said fuse link and draw an arc of predetermined arc length when said fuse link breaking element disengages said swing end portion of said ejector element.

2. An electric cutout according to claim 1 wherein said ramp portion of said ejector element is disposed at an angle in the range of approximately 20 degrees to 40 degrees from the plane of said swing end of said ejector element.

3. An electric cutout according to claim 1 wherein said ramp portion of said ejector element is disposed at an angle of approximately 30 degrees from the plane of said swing end of said ejector element.

4. An electric cutout according to claim 1 wherein said manually operable fuse breaking element is pivotally mounted to said lower tube casting on the side thereof opposite from the side on which said conducting hinge element is mounted.

5. An electric cutout according to claim 1 wherein said manually operable fuse breaking element comprises a pair of arms between which said extension of said fuse link is disposed.

6. An electric cutout according to claim 5 wherein said manually operable fuse breaking element comprises a cross bar interconnecting the swing ends of said arms.

7. An electric cutout according to claim 6 wherein said cross bar initially engages said ramp portion of said ejector element to impart a gradually increasing fuse link breaking force to said fuse link.

8. An electric cutout according to claim 6 wherein said cross bar engages said swing end of said ejector element during a final portion of a circuit interruption so as rapidly to withdraw said extension from said fuse tube.

9. An electric cutout according to claim 1 wherein the arc length is approximately one inch at the time the link break cross bar disengages the swing end of the ejector.

10. An electric cutout according to claim 1 wherein a maximum possible travel of said extension and of portions of said fuse link which are connected therewith is in excess of three inches at the time when the link break cross bar is disposed directly below the pivotal mounting of said fuse link breaking element.

* * * * *